US006734610B2

(12) United States Patent
Cozar et al.

(10) Patent No.: US 6,734,610 B2
(45) Date of Patent: May 11, 2004

(54) MASKING DEVICE FOR A FLAT-SCREEN COLOR-DISPLAY CATHODE-RAY TUBE WITH A TENSIONED SHADOW MASK MADE OF FE-NI ALLOYS

(75) Inventors: Ricardo Cozar, La Fermete (FR); Pierre-Louis Reydet, Montigny Aux Amognes (FR); Lucien Coutu, Suavugny les Bois (FR)

(73) Assignee: Imphy Ugine Precision, Puteaux (FR)

( * ) Notice: Subject to any disclaimer, the term of this patent is extended or adjusted under 35 U.S.C. 154(b) by 101 days.

(21) Appl. No.: 09/817,242

(22) Filed: Mar. 27, 2001

(65) Prior Publication Data

US 2002/0008456 A1 Jan. 24, 2002

(30) Foreign Application Priority Data

Mar. 31, 2000 (FR) ..... 00 04080

(51) Int. Cl.[7] ..... H01J 29/80
(52) U.S. Cl. ..... 313/407; 313/402
(58) Field of Search ..... 313/402, 407

(56) References Cited

U.S. PATENT DOCUMENTS 4,639,576 A * 1/1987 Shoemaker et al. ... 219/146.23
4,713,576 A * 12/1987 Misumi et al. ..... 313/402
5,502,350 A 3/1996 Uehara et al.
5,643,697 A * 7/1997 Baudry et al. ..... 430/5
5,811,918 A 9/1998 Van Den Berg et al.
5,914,557 A * 6/1999 Tai et al. ..... 313/407
6,229,255 B1 * 5/2001 Kim et al. ..... 313/402
6,420,054 B1 * 7/2002 Cozar et al. ..... 148/621

FOREIGN PATENT DOCUMENTS

DE 199 19 812 11/1999
EP 1 063 304 6/2000

* cited by examiner

*Primary Examiner*—Askok Patel
*Assistant Examiner*—German Colon
(74) *Attorney, Agent, or Firm*—Sughrue Mion, PLLC

(57) ABSTRACT

Masking device for a flat-screen color-display cathode-ray tube, comprising a support frame for a tensioned shadow mask and a tensioned shadow mask. The support frame is made of a hardened Fe—Ni alloy having a thermal expansion coefficient between 20° C. and 150° C. of less than $5\times10^{-6}$ $K^{-1}$ and a yield stress $R_{p0.2}$ at 20° C. of greater than 700 MPa; the tensioned shadow mask is made of an Fe—Ni alloy having a thermal expansion coefficient between 20° C. and 150° C. of less than $3\times10^{-6}$ $K^{-1}$; the Fe—Ni alloys are chosen so that: below a temperature $T_1$, the mean expansion coefficient $\alpha_{20\text{-}T}$, between 20° C. and T, of the alloy of the support frame is greater than the mean expansion coefficient $\alpha_{20\text{-}T}$ of the alloy of the shadow mask, and above $T_1$ the coefficient $\alpha_{20\text{-}T}$ of the alloy of the frame is less than the coefficient $\alpha_{20\text{-}T}$ of the alloy of the shadow mask, where $T_1$<350° C. and preferably <300° C.

7 Claims, 1 Drawing Sheet

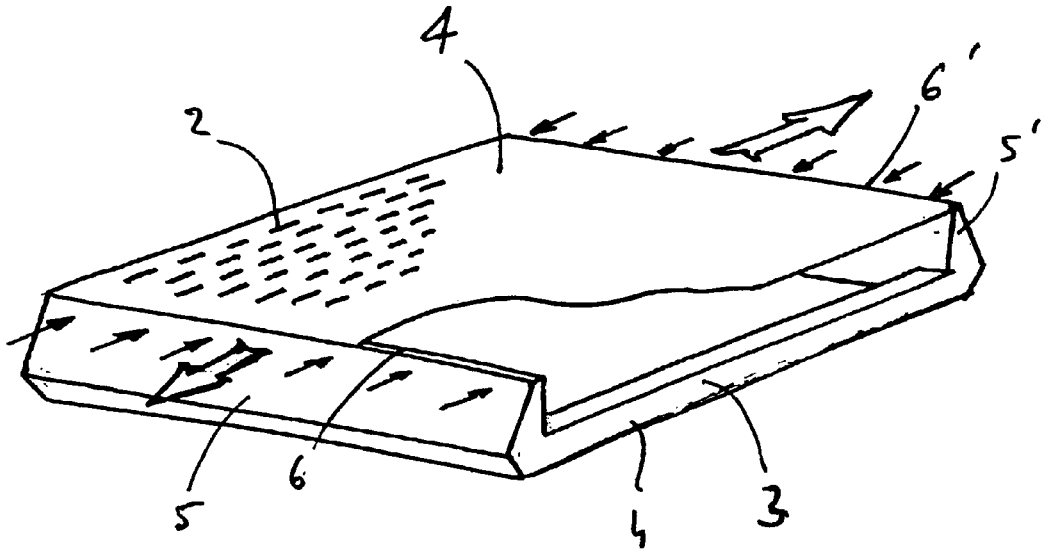
4
2
6'
5'
5
6
4
3

MASKING DEVICE FOR A FLAT-SCREEN COLOR-DISPLAY CATHODE-RAY TUBE WITH A TENSIONED SHADOW MASK MADE OF FE-NI ALLOYS

BACKGROUND OF THE INVENTION

The present invention relates to a masking device for a flat-screen colour-display cathode-ray tube, of the type comprising a support frame for a tensioned shadow mask and to a tensioned shadow mask mounted on the support frame.

Colour-display cathode-ray tubes comprise, in a known manner, a display screen provided with phosphors, an electron gun producing three electron beams and a masking device consisting of a shadow mask mounted on a support frame, placed opposite the display screen and intended to ensure that the image displayed is of high quality. The shadow mask consists of a metal foil perforated by a plurality of holes or slits through which the three electron beams pass in order to excite the phosphors disposed on the screen. The image quality obtained is better the more precise the alignment between the phosphors, the holes in the shadow mask and the electron beams. When the display tube is in operation, a significant portion of the electron beams is intercepted by the shadow mask. This causes local heating of the shadow mask, which may deform it, and therefore the quality of the displayed image may suffer. In addition, the image quality may also suffer owing to the vibrations of the shadow mask which are caused by various vibration sources. In order to obtain high-quality images, the shadow mask must, on the one hand, be insensitive to the local heating and, on the other hand, it must have a natural vibration frequency high enough for the amplitude of these vibrations not to disturb the colour of the images by a misalignment between the electron beams, the holes in the shadow mask and the phosphors.

When the display screen is curved, the shadow mask has a shape which matches that of the screen, and the problems of sensitivity to local heating and of vibration are solved by making the shadow mask by drawing a foil, made of an Fe—Ni alloy having a very low thermal expansion coefficient, perforated by holes. The shadow mask is simply welded onto a support frame which exerts no force on the shadow mask. The frame may therefore be lightweight, which has advantages.

When the display screen is flat, the shadow mask may be an undrawn foil fixed, for example, by welding to a pre-compressed support frame which then exerts tension on the shadow mask. The shadow mask is then referred to as a "tensioned" mask. The tension in the shadow mask is intended, on the one hand, to solve the problem of sensitivity to local heating and, on the other hand, to increase the natural vibration frequency of the shadow mask in order to attenuate the amplitude of these vibrations. This solution assumes, in particular, the use of a material whose characteristics allow sufficient tension to be maintained in the operating temperature range of the cathode-ray tube (approximately 100° C.), and to do so after heating to about 600° C. during the process for manufacturing the cathode-ray tube. This is because the shadow mask, mounted so as to be tensioned on its support frame, is heated a first time to around 600° C., in order to cause what is called "blackening" oxidation, and then a second time to around 450° C. after the assembly has been mounted in the cathode-ray tube, during the operation of sealing the screen-tile to the glass cone, and finally a third time in the region of 380° C. when evacuating the cathode-ray tube. These heating operations may cause the shadow mask and its frame to creep, which may relax the shadow mask.

In order to manufacture a tensioned shadow mask and its support frame, it has been proposed to use a low-alloy steel (that is to say one containing, in general, less than 5% of alloying elements). However, since the thermal expansion coefficient of this steel is high, the tension in the shadow mask must be greater than 200 MPa in order to prevent deformations due to local heating. This solution results in a heavy frame, the weight of which may reach, or even exceed, 6 kg.

In order to manufacture a tensioned shadow mask and its support frame, it has also been proposed to produce the shadow mask from an Fe—Ni alloy having a low expansion coefficient and the frame from steel. However, it is then necessary to provide means for preventing the shadow mask from being over-tensioned during heating at 600° C., without which the shadow mask would tear during this operation.

To manufacture a tensioned shadow mask and its support frame, it has also been proposed to produce the shadow mask and the support frame from Fe—Ni alloys having a low expansion coefficient, it being possible for the Fe—Ni alloy of the support frame to be identical to or different from the Fe—Ni alloy of the shadow mask. This solution may cause defects within the shadow mask, these defects being visible after heating to 600° C. This is because the support frame, of rectangular overall shape, has two end uprights to which the shadow mask is attached and two lateral uprights which ensure that the separation between the end uprights is maintained. The shadow mask, also of rectangular overall shape, is attached to the end uprights, generally by welding, along two of its opposed sides. In any event, the tension exerted on the shadow mask in the longitudinal direction generates a tension in the transverse direction. During heating to high temperature, these tensions may cause creep phenomena which, because of the holes or slits in the shadow mask, may cause an elongation in the transverse direction of the shadow mask. If during heating to 600° C. the end uprights of the support frame expand as much as or more than the shadow mask, the initial tension in the transverse direction will be retained or increased. After returning to room temperature, the end uprights of the support frame resume their original dimensions, whereas the shadow mask has a slightly increased width because of the creep. This phenomenon may result in corrugations in the shadow mask, making it unusable. This defect, which is more pronounced the larger the shadow mask, may be aggravated by the fact that, on cooling after the 600° C. hold, the shadow mask cools more quickly than the frame.

SUMMARY OF THE INVENTION

It is an object of the present invention to remedy these drawbacks by providing a means for manufacturing a tensioned shadow mask and its support frame which are insensitive to the local heating, having a suitable natural vibration frequency and having good flatness after the high-temperature heating resulting from the manufacturing operations.

For this purpose, the subject of the invention is a masking device for a flat-screen colour-display cathode-ray tube, of the type comprising a support frame for a tensioned shadow mask and a tensioned shadow mask mounted on the support frame so as to be subjected to tension at room temperature. The support frame is made of a hardened Fe—Ni alloy having a thermal expansion coefficient between 20° C. and 150° C. of less than $5\times10^{-6}$ $K^{-1}$ and a yield stress $R_{p0.2}$ at 20° C. of greater than 700 MPa. The tensioned shadow mask is made of an Fe—Ni alloy having a thermal expansion coefficient between 20° C. and 150° C. of less than $3\times10^{-6}$ $K^{-1}$. The hardened Fe—Ni alloy of which the support frame is made and the Fe—Ni alloy of which the shadow mask is made are chosen in such a way that, below a temperature $T_1$, the mean expansion coefficient $\alpha_{20-T}$, between 20° C. and the temperature T, of the hardened Fe—Ni alloy of which the support frame is made is greater than the mean expansion coefficient $\alpha_{20-T}$, between 20° C. and the temperature T, of the Fe—Ni alloy of which the shadow mask is made; above the said temperature $T_1$, the mean expansion coefficient $\alpha_{20-T}$, between 20° C. and the temperature T, of the hardened Fe—Ni alloy of which the support frame is made is less than the mean expansion coefficient $\alpha_{20-T}$, between 20° C. and the temperature T, of the Fe—Ni alloy of which the shadow mask is made; the said temperature $T_1$ is less than 350° C. and preferably less than 300° C.

Preferably, the hardened Fe—Ni alloy of which the support frame is made is an Fe—Ni alloy of the "γ'-hardened" type whose chemical composition comprises, by weight:

40.5%≦Ni+Co+Cu≦43.5%

0%≦Co≦5%

0%≦Cu≦3%

1.5%≦Ti≦3.5%

0.05%≦Al≦1%

C≦0.05%

Si≦0.5%

Mn≦0.5%

S≦0.01%

P≦0.02% the balance being iron and impurities resulting from the smelting, and the Fe—Ni alloy of which the shadow mask is made is an Fe—Ni alloy whose composition comprises, by weight:

32%≦Ni+Co+Cu≦37%

0%≦Co≦5.5%

0%≦Cu≦2%

0%≦Nb+Ta+Mo+W+Zr≦2%

0≦Mn≦0.5%

Si<0.2%

C<0.02%

S<0.01%

P<0.02% the balance being iron and impurities resulting from the smelting.

The chemical composition of the Fe—Ni alloy of which the shadow mask is made may, for example, be such that:

32%≦Ni+Co+Cu≦35.5%

0%≦Co≦4%

0%≦Cu≦2%

0%≦Nb+Ta+Mo+W+Zr<0.2%.

The chemical composition of the Fe—Ni alloy of which the shadow mask is made may likewise be such that:

33.5%≦Ni+Co+Cu≦37%

0%≦Co≦5.5%

0%≦Cu≦2%

0.2%≦Nb+Ta+Mo+W+Zr≦2%.

In another embodiment, the hardened Fe—Ni alloy of which the shadow frame is made may be an Fe—Ni alloy of the "γ'-hardened" type whose chemical composition comprises, by weight:

43.5%≦Ni+Co+Cu≦45.5%

0%≦Co≦5%

0%≦Cu≦3%

1.5%≦Ti≦3.5%

0.05%≦Al≦1%

C≦0.05%

Si≦0.5%

Mn≦0.5%

S≦0.01%

P≦0.02% the balance being iron and impurities resulting from the smelting, and the Fe—Ni alloy of which the shadow mask is made may be an Fe—Ni alloy whose chemical composition comprises, by weight:

35.5%≦Ni+Co+Cu≦37%

0%≦Co≦5.5%

0%≦Cu≦2%

0≦Mn≦0.5%

Si<0.2%

C<0.02%

S<0.01%

P<0.02% the balance being iron and impurities resulting from the smelting.

The invention also relates to a tensioned shadow mask consisting of an Fe—Ni alloy whose chemical composition comprises, by weight:

32%≦Ni+Co+Cu≦37%

0%≦Co≦5.5%

0%≦Cu≦2%

0%≦Nb+Ta+Mo+W+Zr≦2%

0≦Mn≦0.5%

Si<0.2%

C<0.02%

S<0.01%

P<0.02% the balance being iron and impurities resulting from the smelting.

The chemical composition of the Fe—Ni alloy of which the shadow mask is made may preferably be such that:

32%≦Ni+Co+Cu≦35.5%

0%≦Co≦4%

0%≦Cu≦2%

0%≦Nb+Ta+Mo+W+Zr≦0.2%.

The chemical composition of the Fe—Ni alloy of which the shadow mask is made may likewise be such that:

33.5%≦Ni+Co+Cu≦37%

0%≦Co≦5.5%

0%≦Cu≦2%

0.2%≦Nb+Ta+Mo+W+Zr≦2%.

Finally, the frame may also be made of a hardened Fe—Ni alloy of the "beryllium-hardened" type, of the "carbide-hardened" type or of the "solid-solution-hardened" type.

BRIEF DESCRIPTION OF THE DRAWING

The invention will now be described in greater detail and illustrated by examples, but in a non-limiting manner, with regard to the appended drawing figure which shows in perspective, schematically, a masking device for a flat-screen colour-display cathode-ray tube.

DETAILED DESCRIPTION OF THE INVENTION

The masking device for a flat-screen colour-display cathode-ray tube shown in the drawing figure comprises a shadow mask 1 consisting of a foil perforated by a plurality of holes 2, and a support frame 3 having lateral uprights 4 (only one of which can be seen in the figure) and end uprights 5 and 5'. The shadow mask 1 is fixed, for example by welding, to the upper edges 6 and 6 of the end uprights 5 and 5'.

During the mounting operation, the support frame 3 is subjected to compressive forces (small arrows in the drawing figure) intended to induce an elastic deformation which reduces the distance separating the end uprights 5 and 5', and the shadow mask is subjected to tensile forces (large arrows in the drawing figure) intended to induce an elongational elastic deformation. The shadow mask is then attached to the support frame by welding and the compressive and tensile forces are released. However, elastic deformations of the support frame and of the shadow mask subsist, so that the shadow mask remains under tension.

The device consisting of the support frame and of the shadow mask is then heated to a temperature of about 600° C. in a slightly oxidizing atmosphere, so as to create a thin oxide layer on the surface. This operation is usually called "blackening". The device is then mounted in the cathode-ray tube, which is then sealed at a temperature of around 450° C. for about one hour. Finally, the cathode-ray tube is evacuated and, during this operation, it is heated to around 380° C. During these various heating operations, and in particular during the heating at around 600° C., the frame and the shadow mask expand. When the frame and the shadow mask are made of different materials, the expansion of the frame is different from that of the shadow mask. In particular, if, at 600° C., the expansion of the frame is greater than the expansion of the mask, the difference in expansion induces an additional tension in the shadow mask which may cause the shadow mask to creep. If this creep is too high, it has two effects:

- in the longitudinal direction, that is to say parallel to the lateral uprights, the creep increases the length of the shadow mask at room temperature, thereby decreasing its tension; a small creep is favourable, or even desirable, as it makes the distribution of the tensile stresses over the width symmetrical. However, if this creep is too high, the tension in the shadow mask becomes too low, and consequently the natural vibration frequencies of the shadow mask become too low;
- in the transverse direction, that is to say parallel to the end uprights, the creep increases the width of the shadow mask at room temperature, which becomes greater than the length of the end uprights to which it is attached by welding; as a result, corrugations form. This phenomenon is especially pronounced if the shadow mask is perforated by a multitude of holes or slots which reduce its effective cross section. In particular, between the slots, the cross section is obviously reduced and therefore the tensile stress is increased; as a result, the risk of creep is much higher.

The inventors have found that these two drawbacks could be avoided if alloys chosen as indicated above were to be used to produce the shadow mask and the support frame.

The shadow mask must be made of an Fe—Ni alloy having a mean thermal expansion coefficient between 20° C. and 150° C. ($\alpha_{20\text{-}150}$) of less than $3\times10^{-6}$ $K^{-1}$ so as to have a low sensitivity to local heating when the cathode-ray tube is in operation.

The frame must be made of a hardened Fe—Ni alloy having a yield stress $R_{p0.2}$ at 20° C. of greater than 700 MPa so as to be able to withstand the tensile forces in the shadow mask. In addition, this alloy must have a mean thermal expansion coefficient between 20° C. and 150° C. ($\alpha_{20\text{-}150}$) greater than that of the alloy of which the shadow mask is made, so as to prevent the shadow mask from relaxing when it is heated, but this coefficient must, nevertheless, remain less than $5\times10^{-6}$ $K^{-1}$ so as to prevent the shadow mask from being excessively overtensioned.

Furthermore, and to avoid the aforementioned drawbacks resulting from high-temperature heating, above 350° C., and better still above 300° C., the mean expansion coefficient between 20° C. and any temperature T greater than 350° C., or better still greater than 300° C., $\alpha_{20\text{-}T}$, of the alloy of which the frame is made must be less than the corresponding mean thermal expansion coefficient of the alloy of which the shadow mask is made. If this is the case, the dimensions of the shadow mask at high temperature will be increased more than those of the frame and as a result the tensions exerted on the shadow mask will be relaxed; there will be no or little creep.

The set of conditions relating to the expansion coefficients may be expressed in an equivalent manner, as done previously, by introducing a temperature $T_1$, which is less than 350° C. or better still less than 300° C., so that, for any temperature T:

- if $T<T_1$, then the $\alpha_{20\text{-}T}$ of the shadow mask is less than the $\alpha_{20\text{-}T}$ of the frame (at least for T>20° C.);
- if $T>T_1$, then the $\alpha_{20\text{-}T}$ of the shadow mask is greater than the $\alpha_{20\text{-}T}$ of the frame (at least for T up to 600° C.).

To satisfy these conditions, the frame may be made of a hardened Fe—Ni alloy of the "γ'-hardened" type whose chemical composition comprises, by weight:

$40.5\% \leqq Ni+Co+Cu \leqq 43.5\%$ $0\% \leqq Co \leqq 5\%$ $0\% \leqq Cu \leqq 3\%$ $1.5\% \leqq Ti \leqq 3.5\%$ $0.05\% \leqq Al \leqq 1\%$ $C \leqq 0.05\%$ $Si \leqq 0.5\%$ $Mn \leqq 0.5\%$ $S \leqq 0.01\%$ $P \leqq 0.02\%$ the balance being iron and impurities resulting from the smelting.

In this alloy, the elements Co and Cu are not absolutely essential and may be in trace amounts or even absent. The same applies to the elements C, Si, Mn, S and P.

The shadow mask may then be made of an Fe—Ni alloy whose chemical composition comprises, by weight:

$32\% \leqq Ni+Co+Cu \leqq 37\%$ $0\% \leqq Co \leqq 5.5\%$ $0\% \leqq Cu \leqq 2\%$ $0\% \leqq Nb+Ta+Mo+W+Zr \leqq 2\%$ $0 \leqq Mn \leqq 0.5\%$ $Si<0.2\%$ $C<0.02\%$ $S<0.01\%$ $P<0.02\%$ the balance being iron and impurities resulting from the smelting.

In this alloy, the elements Co and Cu are not absolutely essential and may be in trace amounts or even absent. The same applies to the elements C, Si, Mn, S and P.

Likewise, the elements Nb, Ta, Mo, W and Zr are not absolutely essential and may be in trace amounts, or even absent. However, in significant amounts, that is to say when the sum of their content is greater than about 0.2%, these elements favourably increase the creep resistance since this reduces the risks associated with high-temperature heating.

However, these elements have an effect on the expansion coefficient and it is preferable to choose:

either an alloy whose chemical composition is such that:

32%≦Ni+Co+Cu≦35.5%

0%≦Co≦4%

0%≦Cu≦2%

0%≦Nb+Ta+Mo+W+Zr<0.2%;

or an alloy whose chemical composition is such that:

33.5%≦Ni+Co+Cu≦37%

0%≦Co≦5.5%

0%≦Cu≦2%

0.2%≦Nb+Ta+Mo+W+Zr≦2%.

By way of example, an Fe—Ni alloy of the Fe-42.5Ni-2.6Ti-0.2Al "γ'-hardened" type (containing about 42.5% nickel, 2.6% titanium and 0.2% aluminium in the case of the main elements) may be used for the frame, and an Fe—Ni alloy of the Fe-34.7Ni type may be used for the shadow mask. The hardened alloy has a yield stress $R_{p0.2}$ at 20° C. of greater than 700 MPa in the hardened state and the mean expansion coefficients are:

| $\alpha_{20\text{-}T}$ | T = 50° C. | T = 150° C. | T = 225° C. | T = 300° C. | T = 400° C. | T = 500° C. | T = 600° C. |
|---|---|---|---|---|---|---|---|
| Fe-42.5Ni-2.6Ti-0.2Al | $3 \times 10^{-6}$ K$^{-1}$ | $3.4 \times 10^{-6}$ K$^{-1}$ | $4 \times 10^{-6}$ K$^{-1}$ | $5.4 \times 10^{-6}$ K$^{-1}$ | $7.9 \times 10^{-6}$ K$^{-1}$ | $9.5 \times 10^{-6}$ K$^{-1}$ | $10.8 \times 10^{-6}$ K$^{-1}$ |
| Fe-34.7Ni | $0.8 \times 10^{-6}$ K$^{-1}$ | $2 \times 10^{-6}$ K$^{-1}$ | $4 \times 10^{-6}$ K$^{-1}$ | $6.6 \times 10^{-6}$ K$^{-1}$ | $9.1 \times 10^{-6}$ K$^{-1}$ | $10 \times 10^{-6}$ K$^{-1}$ | $12 \times 10^{-6}$ K$^{-1}$ |

In this case, $T_1$ is equal to 225° C. Consequently, the shadow mask has satisfactory tension and planarity after it has been fitted into the cathode-ray tube, including for large-sized screens having diagonals of 68 cm, 80 cm, 90 cm or even larger.

Again using the Fe-42.5Ni-2.6Ti-0.2Al alloy for the frame and the Fe-36Ni-1.2Nb alloy for the shadow mask, the mean expansion coefficients are:

| $\alpha_{20\text{-}T}$ | T = 50° C. | T = 150° C. | T = 225° C. | T = 300° C. | T = 400° C. | T = 500° C. | T = 600° C. |
|---|---|---|---|---|---|---|---|
| Fe-42.5Ni-2.6Ti-0.2Al | $3 \times 10^{-6}$ K$^{-1}$ | $3.4 \times 10^{-6}$ K$^{-1}$ | $4 \times 10^{-6}$ K$^{-1}$ | $5.4 \times 10^{-6}$ K$^{-1}$ | $7.9 \times 10^{-6}$ K$^{-1}$ | $9.5 \times 10^{-6}$ K$^{-1}$ | $10.8 \times 10^{-6}$ K$^{-1}$ |
| Fe-36Ni-1.2Nb | $1.2 \times 10^{-6}$ K$^{-1}$ | $2.1 \times 10^{-6}$ K$^{-1}$ | $4 \times 10^{-6}$ K$^{-1}$ | $6.5 \times 10^{-6}$ K$^{-1}$ | $9 \times 10^{-6}$ K$^{-1}$ | $10.7 \times 10^{-6}$ K$^{-1}$ | $11.9 \times 10^{-6}$ K$^{-1}$ |

In this case, $T_1$ is equal to 225° C. Consequently, the shadow mask has satisfactory tension and planarity after it has been fitted into the cathode-ray tube, including for large-sized screens having diagonals of 68 cm, 80 cm, 90 cm or even larger.

By way of comparison, when the frame is made of Fe-42.5Ni-2.6Ti-0.2Al alloy and the shadow mask is made of Fe-36Ni (a conventional INVAR® alloy), the expansion coefficients are:

| $\alpha_{20\text{-}T}$ | T = 50° C. | T = 150° C. | T = 200° C. | T = 300° C. | T = 400° C. | T = 500° C. | T = 600° C. |
|---|---|---|---|---|---|---|---|
| Fe-42.5Ni-2.6Ti-0.2Al | $3 \times 10^{-6}$ K$^{-1}$ | $3.4 \times 10^{-6}$ K$^{-1}$ | $3.8 \times 10^{-6}$ K$^{-1}$ | $5.4 \times 10^{-6}$ K$^{-1}$ | $7.9 \times 10^{-6}$ K$^{-1}$ | $9.5 \times 10^{-6}$ K$^{-1}$ | $10.8 \times 10^{-6}$ K$^{-1}$ |
| Fe-36Ni | $0.8 \times 10^{-6}$ K$^{-1}$ | $1.4 \times 10^{-6}$ K$^{-1}$ | $2 \times 10^{-6}$ K$^{-1}$ | $5 \times 10^{-6}$ K$^{-1}$ | $7.8 \times 10^{-6}$ K$^{-1}$ | $9.6 \times 10^{-6}$ K$^{-1}$ | $11.1 \times 10^{-6}$ K$^{-1}$ |

In this case, $T_1$ is equal to about 440° C. It was found that the shadow mask, although having a satisfactory tension, may have corrugations after it is fitted into the cathode-ray tube, especially when the screens are large. This is because the risk of corrugation is all the greater the larger the screens. For frames that are not too large (diagonal less than 76 cm), this solution may give satisfactory results even though this is not always very reliable because of the scatter inherent in any industrial production.

In another embodiment, the hardened Fe—Ni alloy of which the shadow frame is made may be an Fe—Ni alloy of the "γ'-hardened" type whose chemical composition comprises, by weight:

43.5%≦Ni+Co+Cu≦45.5%

0%≦Co≦5%

0%≦Cu≦3%

1.5%≦Ti≦3.5%

0.05%≦Al≦1%

C≦0.05%

Si≦0.5%

Mn≦0.5%

S≦0.01%

P≦0.02% the balance being iron and impurities resulting from the smelting, and the Fe—Ni alloy of which the shadow mask is made may be an Fe—Ni alloy whose chemical composition comprises, by weight:

35.5%≦Ni+Co+Cu≦37%

0%≦Co≦5.5%

0%≦Cu≦2%

0≦Mn≦0.5%

Si<0.2%

C<0.02%

S<0.01%

P<0.02% the balance being iron and impurities resulting from the smelting.

As an example of this embodiment, the frame is made of an Fe-44.1Ni-2.6Ti-0.2Al alloy which has a yield stress $R_{p0.2}$ at 20° C. in the hardened state of greater than 700 MPa and the shadow mask is made of Fe-36Ni (a conventional INVAR® alloy) In this case, the expansion coefficients are:

| $\alpha_{20\text{-}T}$ | T = 50° C. | T = 150° C. | T = 200° C. | T = 300° C. | T = 400° C. | T = 500° C. | T = 600° C. |
|---|---|---|---|---|---|---|---|
| Fe-44.1Ni-2.6Ti-0.2Al | $4.1 \times 10^{-6}$ $K^{-1}$ | $4 \times 10^{-6}$ $K^{-1}$ | $4.1 \times 10^{-6}$ $K^{-1}$ | $5 \times 10^{-6}$ $K^{-1}$ | $7.2 \times 10^{-6}$ $K^{-1}$ | $9 \times 10^{-6}$ $K^{-1}$ | $10.2 \times 10^{-6}$ $K^{-1}$ |
| Fe-36Ni | $0.8 \times 10^{-6}$ $K^{-1}$ | $1.4 \times 10^{-6}$ $K^{-1}$ | $2 \times 10^{-6}$ $K^{-1}$ | $5 \times 10^{-6}$ $K^{-1}$ | $7.8 \times 10^{-6}$ $K^{-1}$ | $9.6 \times 10^{-6}$ $K^{-1}$ | $11.1 \times 10^{-6}$ $K^{-1}$ |

In this case, $T_1$ is equal to 300° C. Consequently, the shadow mask has satisfactory tension and planarity after it is fitted into the cathode-ray tube, including for large-sized screens.

In the examples described above, the frame is always made of an Fe—Ni alloy of the "γ'-hardened" type, but it could also be made of a hardened Fe—Ni alloy of the "carbide-hardened" type, of the "beryllium-hardened" type or of the "solid-solution-hardened" type.

The composition of an alloy of the "carbide-hardened" type comprises, by weight:

36%≦Ni+Co+Cu≦40%

0%≦Co≦5%

0%≦Cu≦3%

1.6%≦Mo≦2.8%

0.4%≦Cr≦1.5%

0.15%≦C≦0.35%

Si≦0.5%

Mn≦0.5%

S≦0.01%

P≦0.02% the balance being iron and impurities resulting from the smelting.

The composition of an alloy of the "beryllium-hardened" type comprises, by weight:

34%≦Ni+Co+Cu≦38%

0%≦Co≦5%

0%≦Cu≦3%

0.15%≦Be≦1%

C≦0.05%

Si≦0.5%

Mn≦1%

S≦0.01%

P≦0.02% the balance being iron and impurities resulting from the smelting.

The composition of an alloy of the "solid-solution-hardened" type comprises, by weight:

38%≦Ni+Co+Cu≦42%

0%≦Co≦5%

0%≦Cu≦3%

1%≦Nb≦4%

C≦0.05%

Si≦0.5%

Mn≦0.5%

S≦0.01%

P≦0.02% the balance being iron and impurities resulting from the smelting.

However, the use of the Fe—Ni alloy of the "γ'-hardened" type has advantages over the alloys of the "carbide-hardened", "beryllium-hardened" or "solid-solution-hardened" type.

This is because the "γ'-hardened" alloy is used in the softened state in order to form and weld the frame and the hardening heat treatment is carried out on the finished frame. As a result, on the one hand, the forming operations are easy to carry out and, on the other hand, the welds are hardened by the hardening treatment.

In contrast, the other hardened alloys must be used in the hardened state (before forming and before welding). As a result, on the one hand, the forming operations are more difficult to carry out and, on the other hand, the welds are softened by the welding heat.

What is claimed is:

1. A masking device for a flat-screen colour-display cathode-ray tube, of the type comprising a support frame for a tensioned shadow mask and a tensioned shadow mask mounted on the support frame so as to be subjected to tension at room temperature, characterized in that:

the support frame is made of a hardened Fe—Ni alloy having a thermal expansion coefficient between 20° C. and 150° C. of less than $5\times10^{-6}K^{-1}$ and a yield stress $R_{p0.2}$ at 20° C. of greater than 700 Mpa, and, for each temperature T, a mean expansion coefficient $\alpha_{20\text{-}T}$ between 20° C. and the temperature T;

the tensioned shadow mask is made of an Fe—Ni alloy having a thermal expansion coefficient between 20° C. and 150° C. of less than $3\times10^{-6}K^{-1}$, and, for each temperature T, a mean expansion coefficient $\alpha_{20\text{-}T}$ between 20° C. and the temperature T;

the hardened Fe—Ni alloy of which the support frame is made and the Fe—Ni alloy of which the shadow mask is made being chosen in such a way that:

when said temperature T is below a temperature $T_1$, said mean expansion coefficient $\alpha_{20\text{-}T}$, between 20° C. and the temperature T, of the hardened Fe—Ni alloy of which the support frame is made is greater than said mean expansion coefficient $\alpha_{20\text{-}T}$, between 20° C. and the temperature T, of the Fe—Ni alloy of which the shadow mask is made, when said temperature T is above said temperature $T_1$, said mean expansion coefficient $\alpha_{20\text{-}T}$, between 20° C. and the temperature T, of the hardened Fe—Ni alloy of which the support frame is made is less than the mean expansion coefficent $\alpha_{20\text{-}T}$, between 20° C. and the temperature T, of the Fe—Ni alloy of which the shadow mask is made, and said temperature $T_1$ is less than 350° C.

2. Device according to claim 1, characterized in that the hardened Fe—Ni alloy of which the support frame is made is an Fe—Ni alloy of the "γ'-hardened" type whose chemical composition comprises, by weight:

40.5%≦Ni+Co+Cu≦43.5%

0%≦Co≦5%

0%≦Cu≦3%

1.5%≦Ti≦3.5%

0.05%≦Al≦1%

C≦0.05%

Si≦0.5%

Mn≦0.5%

S≦0.01%

P≦0.02% the balance being iron and impurities resulting from the smelting, and the Fe—Ni alloy of which the shadow mask is made is an Fe—Ni alloy whose composition comprises, by weight:

$32\% \leqq Ni+Co+Cu \leqq 37\%$ $0\% \leqq Co \leqq 5.5\%$ $0\% \leqq Cu \leqq 2\%$ $0\% \leqq Nb+Ta+Mo+W+Zr \leqq 2\%$ $0 \leqq Mn \leqq 0.5\%$ $Si < 0.2\%$ $C < 0.02\%$ $S < 0.01\%$ $P < 0.02\%$ the balance being iron and impurities resulting from the smelting.

3. Device according to claim 2, characterized in that the chemical composition of the Fe—Ni alloy of which the shadow mask is made is such that:

$32\% \leqq Ni+Co+Cu \leqq 35.5\%$ $0\% \leqq Co \leqq 4\%$ $0\% \leqq Cu \leqq 2\%$ $0\% < Nb+Ta+Mo+W+Zr < 0.2\%$.

4. Device according to claim 2, characterized in that the chemical composition of the Fe—Ni alloy of which the shadow mask is made is such that:

$33.5\% \leqq Ni+Co+Cu \leqq 37\%$ $0\% \leqq Co \leqq 5.5\%$ $0\% \leqq Cu \leqq 2\%$ $0.2\% \leqq Nb+Ta+Mo+W+Zr \leqq 2\%$.

5. Device according to claim 1, characterized in that the hardened Fe—Ni alloy of which the support frame is made is an Fe—Ni alloy of the "γ'-hardened" type whose chemical composition comprises, by weight:

$43.5\% \leqq Ni+Co+Cu \leqq 45.5\%$ $0\% \leqq Co \leqq 5\%$ $0\% \leqq Cu \leqq 3\%$ $1.5\% \leqq Ti \leqq 3.5\%$ $0.05\% \leqq Al \leqq 1\%$ $C \leqq 0.05\%$ $Si \leqq 0.5\%$ $Mn \leqq 0.5\%$ $S \leqq 0.01\%$ $P \leqq 0.02\%$ the balance being iron and impurities resulting from the smelting and the Fe—Ni alloy of which the shadow mask is made is an Fe—Ni alloy whose chemical composition comprises, by weight:

$35.5\% \leqq Ni+Co+Cu \leqq 37\%$ $0\% \leqq Co \leqq 5.5\%$ $0\% \leqq Cu \leqq 2\%$ $0 \leqq Mn \leqq 0.5\%$ $Si < 0.2\%$ $C < 0.02\%$ $S < 0.01\%$ $p < 0.02\%$ the balance being iron and impurities resulting from the smelting.

6. Device according to claim 1, characterized in that the hardened Fe—Ni alloy of which the frame is made is a hardened Fe—Ni alloy of the "beryllium-hardened" type, of the "carbide-hardened" type or of the "solid-solution-hardened" type.

7. The device according to claim 1, wherein said temperature $T_1$ is less than 300° C.

* * * * *